US009713358B2

(12) United States Patent
Pelletier, Jr. et al.

(10) Patent No.: US 9,713,358 B2
(45) **Date of Patent: *Jul. 25, 2017**

(54) FOOTWEAR WITH TWO TONGUES

(71) Applicant: NIKE, Inc., Beaverton, OR (US)

(72) Inventors: Stephen D. Pelletier, Jr., Portland, OR (US); James K. Arizumi, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 50 days.

This patent is subject to a terminal disclaimer.

(21) Appl. No.: 14/590,631

(22) Filed: Jan. 6, 2015

(65) Prior Publication Data

US 2015/0189942 A1 Jul. 9, 2015

Related U.S. Application Data

(62) Division of application No. 12/686,426, filed on Jan. 13, 2010, now Pat. No. 8,959,803.

(60) Provisional application No. 61/145,313, filed on Jan. 16, 2009.

(51) Int. Cl.

| | |
|---|---|
| ***A43B 5/04*** | (2006.01) |
| ***A43B 23/26*** | (2006.01) |
| ***A43B 1/00*** | (2006.01) |
| ***A43C 1/00*** | (2006.01) |
| ***A43B 7/20*** | (2006.01) |

(52) U.S. Cl.

CPC ..... *A43B 5/0401* (2013.01); *A43B 7/20* (2013.01); *A43B 23/26* (2013.01); *A43C 1/003* (2013.01)

(58) Field of Classification Search

CPC ..... A43B 5/0401; A43B 23/26; A43C 1/00; A43C 1/003

USPC ..... 36/50.5, 54, 99, 117.1

See application file for complete search history.

(56) References Cited

U.S. PATENT DOCUMENTS

| | | | |
|---|---|---|---|
| 3,334,427 | A | 8/1967 | Edwards et al. |
| 3,482,336 | A | 12/1969 | Gleisner |
| 4,377,913 | A | 3/1983 | Stone |
| 4,406,073 | A | 9/1983 | Spademan |
| 4,534,122 | A | 8/1985 | MacPhail |
| 5,154,011 | A | 10/1992 | Holzl et al. |
| 5,279,052 | A | 1/1994 | Perotto |
| 5,289,645 | A | 3/1994 | Marega et al. |
| 5,966,843 | A | 10/1999 | Sand et al. |
| 6,408,542 | B1 | 6/2002 | Shepherd |
| 6,681,503 | B2 | 1/2004 | Morle |
| 7,117,616 | B2 | 10/2006 | Hull et al. |

(Continued)

*Primary Examiner* — Sharon M Prange
(74) *Attorney, Agent, or Firm* — Wissing Miller LLP

(57) ABSTRACT

According to various aspects, exemplary embodiments are disclosed of articles of footwear or foot-receiving devices having inner and outer tongues, such as double tongue snowboarding boots, etc. In an exemplary embodiment, an article of footwear or foot-receiving device (e.g., snowboarding boot, etc.) generally includes a housing member at least partially defining a chamber for receiving a foot. An inner tongue is coupled to the housing member. An outer tongue is coupled to at least one of the inner tongue and the housing member. Other aspects of the present disclosure relates to methods. An exemplary method of wearing an article of footwear generally includes tucking a portion of a wearer's pants leg generally between inner and outer tongues of the snowboarding boot. Another example method includes inserting a foot through an opening of a housing member of a foot-receiving device that also includes first and second tongues.

16 Claims, 5 Drawing Sheets

(56) References Cited

U.S. PATENT DOCUMENTS

| | | | |
|---|---|---|---|
| 7,159,340 | B2 | 1/2007 | Borsoi |
| D555,333 | S | 11/2007 | Riebesell et al. |
| 7,386,947 | B2 | 6/2008 | Martin et al. |
| 7,441,348 | B1 | 10/2008 | Dawson |
| 7,802,380 | B2 | 9/2010 | Riebesell |
| D644,018 | S | 8/2011 | Kass |
| 2004/0244221 | A1 | 12/2004 | Hall et al. |
| 2008/0078104 | A1 | 4/2008 | Riebesell |

FOOTWEAR WITH TWO TONGUES

CROSS-REFERENCE TO RELATED APPLICATION

This application is a divisional of co-pending application Ser. No. 12/686,426, filed Jan. 13, 2010, which claims the benefit of provisional application No. 61/145,313, filed Jan. 16, 2009, the disclosures of which are hereby incorporated by reference.

FIELD

The present disclosure relates generally to footwear, and more specifically but not exclusively, to an article of footwear with at least two tongues, such as a double tongue snowboarding boot.

BACKGROUND

This section provides background information related to the present disclosure which is not necessarily prior art.

Conventional footwear generally includes two primary elements, an upper structure and a sole structure. The upper and sole structures are secured or attached to each other, thus forming an interior chamber or cavity for receiving the wearer's foot. The upper structure is generally formed from elements stitched and/or adhesively bonded together to form a structure for receiving the foot. More particularly, conventional footwear may include, for example, a tongue or an exterior formed of leather and textile materials that are resistant to abrasion. The sole structure is usually configured to attenuate ground reaction forces and absorb energy as the footwear contacts the ground, and often incorporates at least two discrete layers that are conventionally referred to as a midsole and an outsole.

Because the upper structure of conventional footwear is configured to receive the foot, the upper structure may not be very stiff or provide much protection to the foot. In addition, conventional footwear includes a single tongue. While engaging in sports or activities, the thickness of the upper structure may help protect the wearer's ankles and/or feet from for example, impact with a tree branch, street rail, etc.

SUMMARY

This section provides a general summary of the disclosure, and is not a comprehensive disclosure of its full scope or all of its features.

According to various aspects, exemplary embodiments are disclosed of articles of footwear or foot-receiving devices having inner and outer tongues, such as double tongue snowboarding boots, etc. In an exemplary embodiment, an article of footwear or foot-receiving device (e.g., snowboarding boot, etc.) generally includes a housing member at least partially defining a chamber for receiving a foot. An inner tongue is coupled to the housing member. An outer tongue is coupled to at least one of the inner tongue and the housing member.

Other aspects of the present disclosure relates to methods. An exemplary method of wearing an article of footwear (e.g., snowboarding boot, etc.) generally includes tucking a portion of a wearer's pant leg between inner and outer tongues of the snowboarding boot. Another example method includes inserting a foot through an opening of a housing member of a foot-receiving device (e.g., snowboarding boot, etc.), that also includes first and second tongues.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
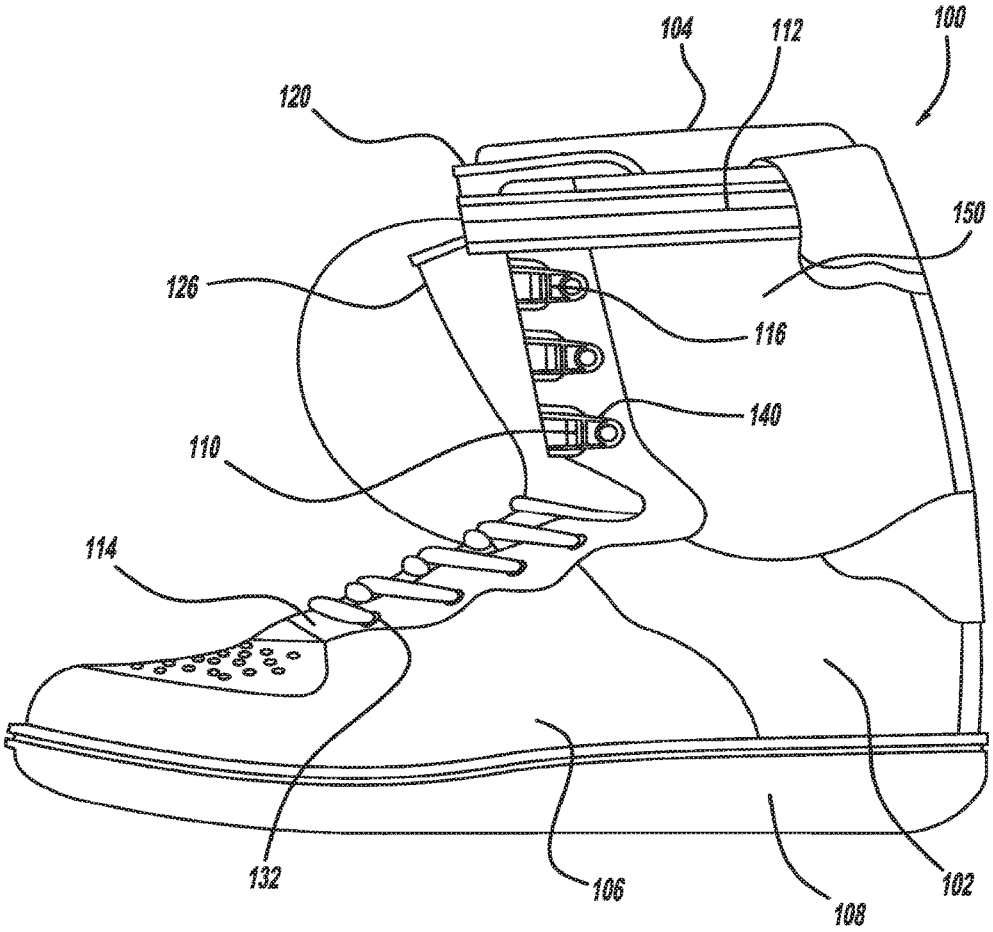
FIG. 1 is a perspective view of an article of footwear (more specifically a double tongue snowboarding boot) according to an exemplary embodiment.

Example embodiments will now be described more fully with reference to the accompanying drawings.

In the following description, numerous details are set forth such as examples of specific components, apparatus, or methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill.

Disclosed herein are exemplary embodiments of "double tongue" articles of footwear or foot-receiving devices having inner and outer tongues. By way of example, exemplary embodiments include "double tongue" snowboarding boots, hiking boots, wakeboarding boots, skate boarding footwear, ice skates, rollerblades, roller skates, walking shoes, running shoes, etc. But aspects of the present disclosure are not necessarily limited to any particular activity or type of footwear, as the present disclosure is applicable to virtually any type of footwear piece including shoes, boots, sneakers, sport-specific shoes (such as golf shoes, tennis shoes, etc.), regardless of the particular activity in which the wearer is engaged.

As disclosed herein, various embodiments include articles of footwear or foot-receiving devices that include a housing member at least partially defining a chamber for receiving the wearer's foot, a sole member, and inner and outer tongues (also referred to as first and second tongues) attached (e.g., stitched, etc.) to the housing member. In some embodiments, the outer tongue may be attached to the housing member and/or the inner tongue by reinforced stitching.

The outer or second tongue of the footwear piece may be configured for increasing the ankle, shin, and/or foot support for the wearer while snowboarding, biking, wakeboarding, skating, walking, hiking, running, etc. The outer tongue may also be configured to increase the stiffness of the article of footwear. Advantageously, the double tongue configuration may also allow the wearer to tuck the pants legs between the inner and outer tongues, for example, to help keep the pants off the ground and without compromising the security of the device or piece around the wearer's foot or ankle.

The second or outer tongue may also be configured, such that the outer tongue assists in keeping the wearer's pants legs out of the way when strapping into, for example, snowboard bindings. Also, in various embodiments, the outer tongue may provide additional space for branding that companies may use for marketing or advertising, such as by putting logos, brands, or trademarks on the front surfaces of the outer tongues, which would not then be concealed by the wearer's pants legs when tucked in between the inner and outer tongues. This is unlike conventional snowboard boots in which the front tongue surface is usually covered by the snowboarder's pants. The outer tongue may also be configured to act as an extra layer of protection for the ankle, foot, and/or shin, in that it is another layer of padding in between the wearer and an impact, whether it be a tree branch, street rail, etc.

In embodiments in which the article of footwear is a snowboarding boot, the outer tongue may be configured so as to not change the overall structure of the boot, while also adding some stiffness in the sweet spot of the flex of the tongue (e.g., the point at which the tongue is the most curved, over the instep of the foot). Plus, the double tongue arrangement may also allow the wearer to employ a sort of "skateboarder-inspired" look in which the outer tongue is hanging out. By way of example, the outer tongue may be configured to be about 45 millimeters lower than the inner shell tongue of a snowboarding boot.

In exemplary embodiments, the outer tongue may be provided with a cutout along each of the two sides or lateral edges. The particular shape (e.g., semi-circular, triangular, rectangular, wedge-shaped, concave, etc.), size, and location of the cutouts may vary, depending, for example, on the particular article of footwear. In an exemplary embodiment including a snowboarding boot, each cutout is generally semi-circular with a height of about 40 millimeters and a depth of about 20 millimeters as measured from the outer edge of the outer tongue. In another exemplary embodiment including a snowboarding boot, each cutout is generally semi-circular with a height of about 45 millimeters and a depth of about 25 millimeters as measured from the outer edge of the outer tongue. These dimensions disclosed herein are mere examples and can be varied.

A wide range of materials may be used for the various components of an article of footwear. By way of example, exemplary embodiments may include a lower section of the outer tongue face being formed from mesh, while an upper section of the outer tongue face is formed from leather or synthetic leather. Continuing with this example, the internal body of the outer tongue may be formed from 8 millimeter thick soft open-cell foam. The lining of the outer tongue may be formed of mesh, which is laminated to 4 millimeters thick polyurethane foam for softness/hand feel. Alternative embodiments, however, may be formed from other materials, depending, for example, on the particular article of footwear, color, style, etc.

The outer tongue may be stitched (e.g., with single stitching, double stitching, reinforced stitching, etc.) into the vamp in between the inner tongue and the vamp. Alternative attachment methods may also be used for the outer tongue.

Figure 6:
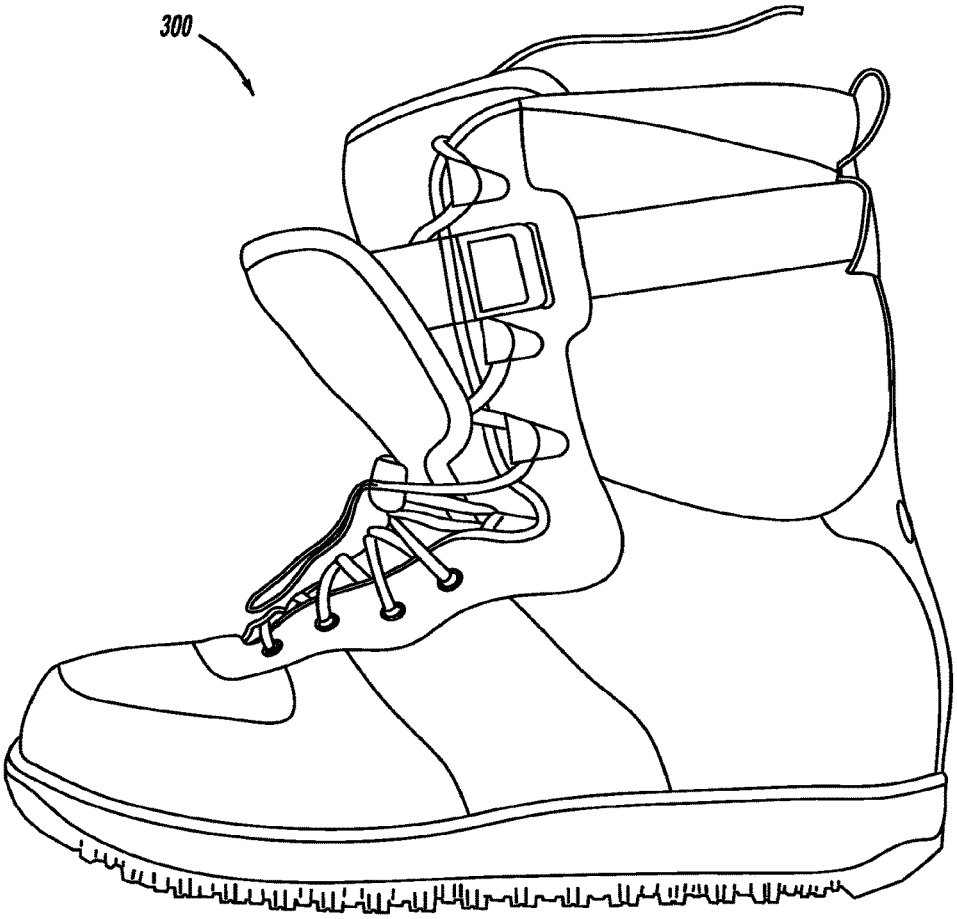
FIG. 6 is a side view of a double tongue snowboarding boot showing a lacing method.

An exemplary lacing process will now be provided for those embodiments in which the article of footwear is a snowboarding boot configured with a closure system that involves laces. In this example, the lower crossovers on the boot (laced through grommets and webbing) are laced on top of the outer tongue. When the laces reach the collar hardware (the metal lace hooks, the top three lace crossovers), the laces can then be laced behind the outer tongue as best shown in FIG. 6. The options of how to lace the outer tongue into the boot may vary, depending, for example, on the wearer's choice, however, the above described method offers a particularly stable configuration. Embodiments of the present disclosure, however, are not limited to only those closure systems that involve laces, as other suitable closure systems may also be employed (e.g., buckles, straps, hook-and-loop fasteners, hook-and-eyelet fasteners, elastic bands, zippers, magnets, etc.).

With reference now to the drawings, FIGS. 1 through 6 illustrate an exemplary embodiment of a snowboarding boot 100 embodying one or more aspects of the present disclosure. As disclosed herein, the snowboarding boot 100 includes a double tongue configuration, which is unlike traditional snowboarding boots, which may have an outer tongue on the shell or other boot member or an inner tongue on a removable insert that fits within the shell.

Figure 7:
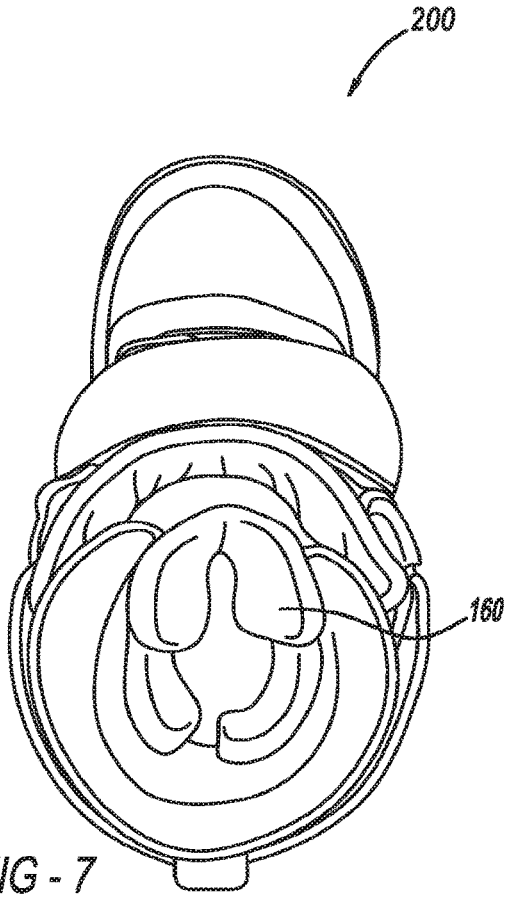
FIG. 7 is an upper view of the double tongue snowboarding boot shown in FIG. 5.

As shown in FIG. 1, the snowboarding boot 100 includes a boot portion or housing member 102. The housing member 102 is configured to define a chamber 104 for receiving the wearer's ankle, foot and a portion of the shin, collectively referred to herein as the lower leg. The snowboarding boot 100 also includes a sole member 108. The housing member 102 extends generally upward from the sole member 108. The housing member 102 may be attached to the sole member 108 by any suitable manner, including adhesives, etc. The housing and sole member may be constructed from leather, synthetic leather, rubber, vinyl, and/or other materials. The housing member 102 can be further defined as including a lower portion 106 and an upper portion 150. Optionally, but preferably with regard to footwear articles such as snowboarding boots, disposed within the housing member 102 is a cushioning insert 160 as best shown in FIG. 7.

Figure 2:
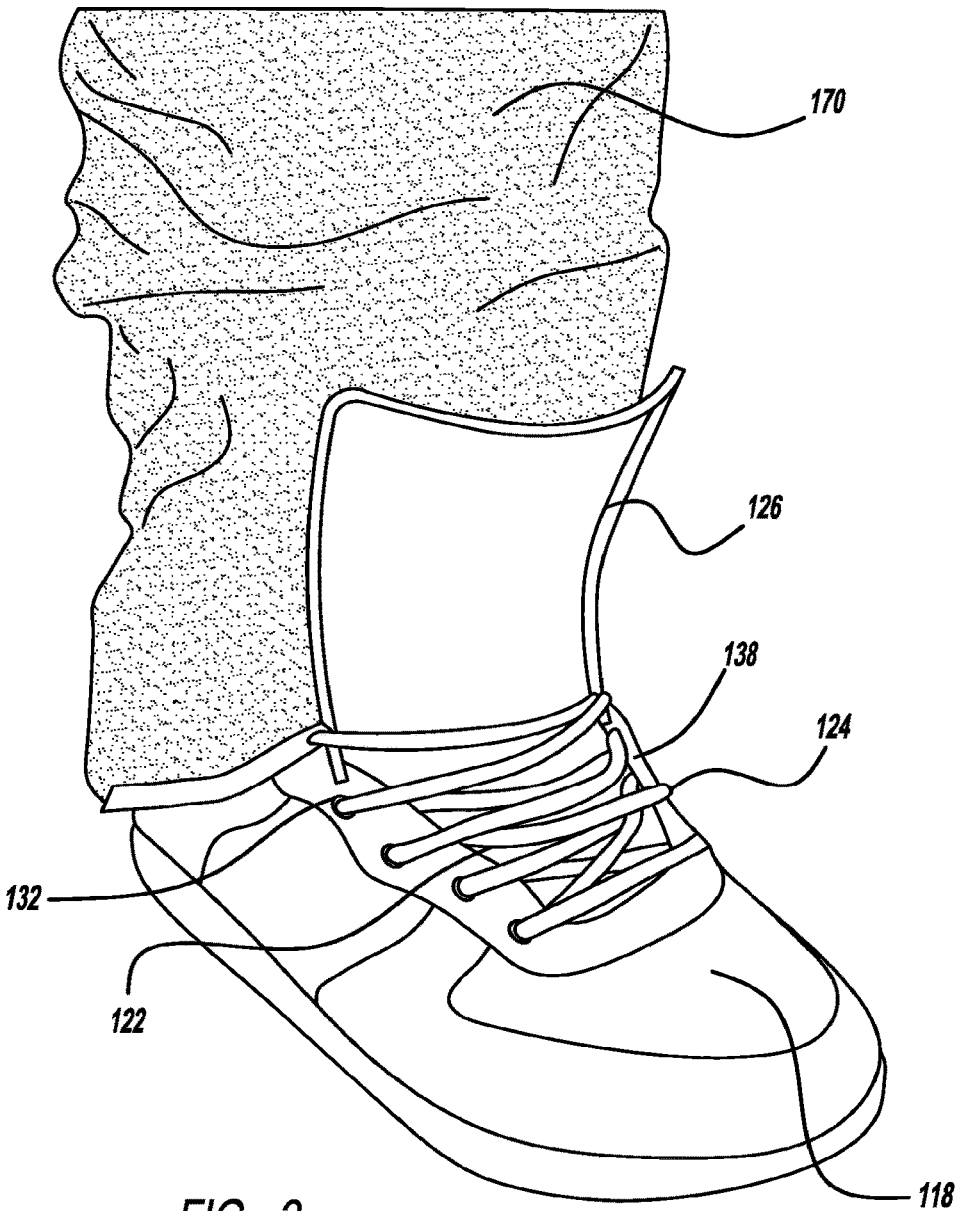
FIG. 2 is a side-elevation view of the snowboarding boot shown in FIG. 1, and illustrating an exemplary manner by which the wearer's pants may be tucked generally between the inner and outer tongues of the snowboarding boot.

The snowboarding boot 100 also includes first and second tongues 120, 126 (also referred to herein as inner and outer tongues 120, 126). As shown in FIG. 2, the wearer's pant leg 170 may be tucked generally between the inner and outer tongues 120, 126, so as to extend upward from the top of the snowboarding boot 100. As will be described in greater detail below, generally at least the top portion of the outer tongue is sufficiently stiff so as to not fold over when the wearer's pant leg is tucked between the first and second tongues.

Also as shown in FIG. 1, the snowboarding boot 100 includes a closure system 110 for, at least partially, helping hold the wearer's foot in the chamber 104. Preferably, the closure system 110 is configured so as to tightly secure the wearer's foot inside the snowboarding boot 100, so as to help keep the wearer's foot stationary within the boot 100.

In this illustrated embodiment, the closure system 110 includes a strap 112 coupled to the housing member 102. In use, the strap 112 may be wrapped about the upper portion 150 of the boot 100 with the wearer's leg therein. The strap 112 assists in maintaining the wearer's ankle, shin, and foot in place while the wearer's legs are moving, including, for example, when the wearer is snowboarding.

The closure system 110 also includes a first securing device 114, which is a lace based securing system in this embodiment comprising eyelets 132 extending along each of the two respective edges 138 of an opening 122 in the housing member 102. A lace 124 may be passed or laced through the eyelets to interconnect the two edges of the opening 122 in the housing member 102. The first securing system 114 is on the front portion 118 of the housing member 102. In use, the first securing device 114 and the lace 124 are configured to assist in securing the wearer's foot in the snowboarding boot 100.

The closure system 110 also includes a second securing device 116, which is a lace based securing system in the form of a metal lace hook system. As shown in FIG. 1, hooks 140 extend along the upper portions of each of the two respective edges of the opening 122 of the housing member 102. The lace 124 may be passed or laced around the hooks 140 to interconnect the two edges of the opening 122 in the housing member 102. The second securing system 116 is on the front portion 118 of the housing member 102. In use, the second securing device 116 and the lace 124 are configured to assist in securing the wearer's foot in the snowboarding boot 100.

Other embodiments, however, may include other suitable systems beside laces, including closure systems that include buckles, straps, hook-and-loop fasteners, hook-and-eyelet fasteners, elastic bands, zippers, magnets, etc. Additionally, a closure system may be located in various other positions relative to the housing member than what is shown in FIG. 1, for example, located on the back portion of the housing member and/or at any other suitable location.

With continued reference to FIGS. 1 and 2, the snowboarding boot 100 includes the inner or first tongue 120. The first tongue 120 is coupled to the housing member 102. The first tongue 120 may be secured to the toe portion of the housing member 102. In use, the first tongue 120 is preferably positioned intermediate the wearer's foot and the two edges of the opening 122 in the housing member 102 and the associated lacing 124 configuration. The first tongue 120 may be relatively flexible, such that it conforms to foot shape or positional changes while still securing or helping to secure the foot in the snowboard boot 100. In this particular example, the first tongue 120 is configured so as to curve generally upward or opposite the direction of the wearer's foot in areas such as, the wearer's instep of the foot. The first tongue 120 may be formed from polymeric materials, mesh, leather, synthetic leather, other suitable materials, combinations thereof, etc.

As illustrated in FIGS. 1 and 2, the snowboarding boot 100 further includes an outer or second tongue 126. The second tongue 126 is coupled to the housing member 102 and/or to the inner tongue 120. In an exemplary embodiment, the second tongue 126 is stitched, preferably with reinforced stitching, into the vamp in between the inner tongue and the vamp. In use, the second tongue 126 may be secured generally between the first securing device 114 and the first tongue 120. The second tongue 126 may be relatively flexible, such that it conforms to foot shape or positional changes while still securing or helping to secure the foot in the snowboard boot 100. In this particular example, the second tongue 126 is configured so as to curve generally upward or opposite the direction of the wearer's foot in areas such as, the wearer's instep of the foot.

In an exemplary embodiment, the second tongue 126 is comprised of more than one material. In the example shown in FIG. 3, the lower portion 128 of the second tongue 126 is comprised of mesh. The upper portion 130 of the second tongue 126 is comprised of leather, synthetic leather, and/or polymeric material. The second tongue 126 may also include reinforced stitching 136 along the edge of the upper portion 130. The internal body of the second tongue 126 may be formed from 8 millimeter thick soft open-cell foam. The second tongue 126 may also include a mesh lining, which is laminated to 4 millimeter thick polyurethane foam, for example, for softness/hand feel. In alternative embodiments, the second tongue may be formed from other materials, such as other polymeric materials, mesh, leather, combinations thereof, etc.

Figure 3:
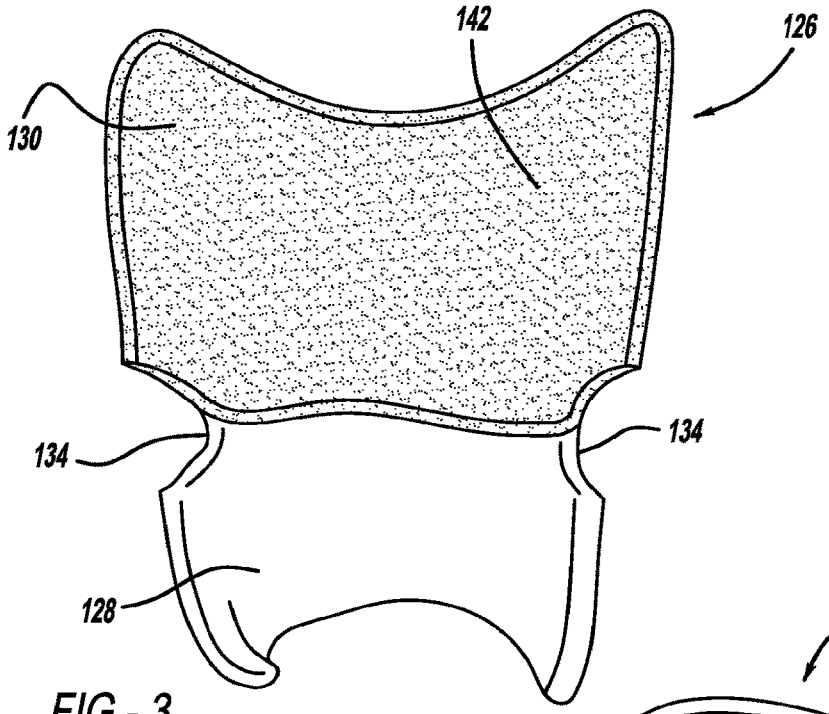
FIG. 3 is a back perspective view illustrating the back surface of the outer tongue shown in FIG. 2.
Figure 4:
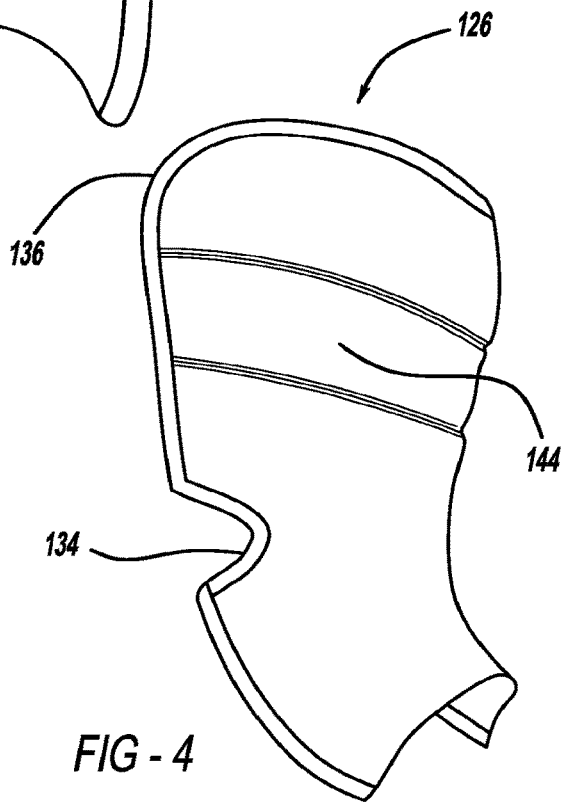
FIG. 4 is a side perspective view of the outer tongue shown in FIG. 3.

As shown in FIGS. 3 and 4, the second tongue 126, includes two portions 134, which are illustrated as cutout portions or concave portions in this example. When the snowboarding boot 100 is in use, the portions 134 may contact the edges of the opening 122 in the housing member 102, such that the lace 124 employed in the first securing device 114 abuts or is received in the second tongue's cut out portions 134 in employing the lace 124 in the second securing device 116.

In various embodiments, the dimensions of portions 134 may vary in height and width. To this end, the second tongue 126 shown in FIG. 3 includes two portions 134 in the form of generally semi-circular or concave cutout. In one particular example, each portion 134 may have a height of about 45 millimeters and a depth of about 25 mm. In another example, the portions 134 may be sized so as to have a height of about 40 millimeters and a depth of about 25 millimeters. Alternative configurations (e.g., sizes, shapes, locations materials, more or less than two cutouts, etc.) may be used. And, all dimensions disclosed herein are mere examples and can be varied. For example, other embodiments may include cutouts that are not concave, such as triangular or rectangular shaped cutouts.

Figure 5:
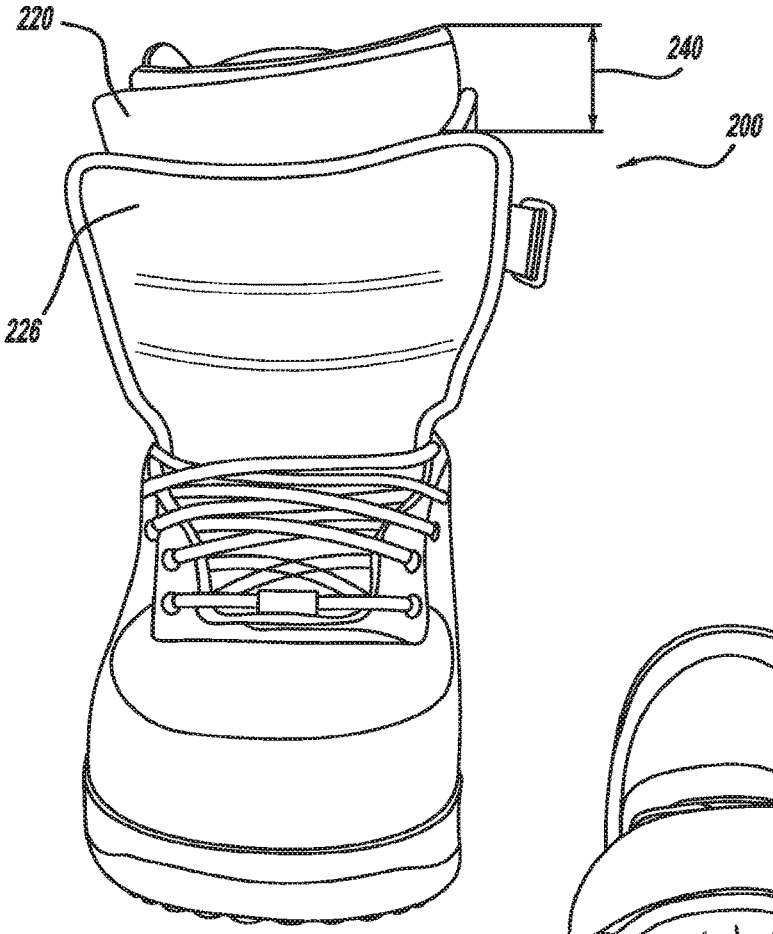
FIG. 5 is a front perspective view of a double tongue snowboarding boot.

In various embodiments, the second tongue may have varying heights. For example, the height of the second tongue may be approximately equal to the height of the first tongue, or the height of the second tongue may be greater or lower than the height of the first tongue. For example, FIG. 5 illustrates a snowboarding boot 200 having first and second tongues 220, 226, where the first tongue 220 has a greater height than the second tongue 226. This particular difference in height 240 between the first tongue 220 and the second tongue 226 is about 45 millimeters in this example. By way of comparison then, this exemplary snowboarding boot 200 thus has an outer tongue 226 that is about 45 millimeters lower than the outer shell tongue of a traditional snowboarding boot. Again, however, these dimensions disclosed herein are mere examples and can be varied.

An exemplary lacing process will now be provided for the snowboarding boot 100 shown in FIG. 1. After inserting the foot into the boot 100, the wearer then laces the lace 124 (e.g., through holes, eyelets or grommets and webbing, etc.) in or through the first securing device 114 over an outer surface 144 of the second tongue 126. The wearer, upon reaching approximately the portions 134 then laces the lace 124 (e.g. through grommets and webbing) in or through the second securing device 116 between the first tongue 120 and the second tongue's inner surface 142 (the inner surface 142 is shown FIG. 3). In various uses, the wearer may secure the wearer's pant leg 170 in between the first and second tongues 120, 126 (FIG. 2), such that the second tongue 126 is outside of and not covered up by the wearer's pant, and such that the first tongue 120 is between the wearer's pant leg 170 and wearer's leg.

It should be understood that embodiments and aspects of the present disclosure may be used with a wide range of not only snowboarding boots, but also a wide range of other articles of footwear. For example, embodiments and aspects of the present disclosure should not be limited to use with any particular size of concave portion (e.g., length, height or width), particular material of a first and second tongue or housing member. Accordingly, the scope of the present disclosure should not be limited to any specific form/type of foot apparel.

Further, the scope of the present disclosure should not be limited to use to any particular environment, as embodiments and aspects of the present disclosure may be used in a wide range of environments, such as in snow, water, nature trails, paved surfaces, such as streets and sidewalks, etc.

Numerical dimensions and values are provided herein for illustrative purposes only. The particular dimensions and values provided are not intended to limit the scope of the present disclosure.

Terms such as "upper," "lower," "inner," "outer," "inwardly," "outwardly," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A method of manufacturing an article of footwear comprising:

attaching a housing member to a sole member, the housing member defining a chamber configured to receive a wearer's foot, ankle, and shin to thereby define a foot portion, an ankle portion, and a shin portion of the housing member;

attaching an inner tongue to the foot portion, the inner tongue extending toward the shin portion, the inner tongue extending across a throat opening that is defined between a first area and a second area of the housing member;

attaching a lower portion of an outer tongue to the foot portion, the outer tongue having an upper portion that extends toward the shin portion, the outer tongue extending across the throat opening, the outer tongue including a cutout portion, the outer tongue including an inner surface facing the chamber and an outer surface facing away from the chamber;

detachably securing the inner tongue to the shin portion by engaging a first securing member to the first area and the second area and extending the first securing member across the throat opening;

detachably securing the lower portion of the outer tongue to the foot portion such that the upper portion remains unsecured from the housing member, wherein detachably securing the lower portion includes: (a) engaging a second securing member, which is independent of the first securing member, to the first area and the second area, and extending the second securing member across the throat opening; (b) receiving the second securing member in the cutout portion to define a first section of the second securing member and a second section of the second securing member; and (c) disposing the first section proximate the outer surface of the outer tongue and disposing the second section proximate the inner surface of the outer tongue.

2. The method of claim 1, wherein the first securing member is a strap, and wherein detachably securing the inner tongue to the shin portion includes securing the strap to the first area and the second area.

3. The method of claim 1, wherein the second securing member is a lace.

4. The method of claim 3, wherein engaging the second securing member includes: (a) receiving the second securing member in a first hole defined in the first area and a second hole defined in the second area; and (b) hooking the second securing member to the first area via a first hook of the housing member and to the second area via a second hook of the housing member.

5. The method of claim 3, further comprising securing both the inner tongue and the outer tongue to the foot portion with the first section of the lace.

6. The method of claim 5, further comprising disposing the second section between the inner tongue and the outer tongue.

7. The method of claim 6, further comprising detachably securing the inner tongue to the shin portion with the second section of the lace.

8. The method of claim 1, wherein receiving the second securing member in the cutout portion includes receiving the second securing member in a first cutout portion of the outer tongue; and further comprising receiving the second securing member in a second cutout portion of the outer tongue;

wherein the second cutout portion is spaced apart at a distance from the first cutout portion.

9. A method of manufacturing an article of footwear comprising:

providing a housing member, wherein the housing member defines a chamber configured to receive a wearer's foot, ankle, and shin to thereby define a foot portion, an ankle portion, and a shin portion of the housing member;

attaching the housing member to a sole member;

attaching an inner tongue to the foot portion, the inner tongue extending toward the shin portion, the inner tongue extending across a throat opening that is defined between a first area and a second area of the housing member;

providing an outer tongue having an upper portion that extends toward the shin portion, an inner surface, an outer surface, and a cutout portion along the lateral edges of the outer tongue;

attaching a lower portion of the outer tongue to the foot portion so that the outer tongue extends across the throat opening and the inner surface faces the chamber and the outer surface faces away from the chamber;

securing the inner tongue to the shin portion by engaging a first securing member to the first area and the second area and extending the first securing member across the throat opening, wherein the first securing member is separable and reusable;

securing the lower portion of the outer tongue to the foot portion such that the upper portion remains unsecured from the housing member, wherein securing the lower portion includes: (a) engaging a second securing member, which is independent of the first securing member and separable and reusable, to the first area and the second area, and extending the second securing member across the throat opening; (b) receiving the second securing member in the cutout portion to define a first section of the second securing member and a second section of the second securing member; and (c) disposing the first section proximate the outer surface of the outer tongue and disposing the second section proximate the inner surface of the outer tongue.

10. The method of claim 9, wherein the step of providing the outer tongue includes forming an internal body of the outer tongue with a foam material.

11. The method of claim 9, wherein the step of providing the outer tongue includes forming a lower section of an outer tongue face from a mesh material.

12. The method of claim 11, wherein the step of providing the outer tongue includes forming an upper section of the outer tongue face from a non-mesh material.

13. The method of claim 12, wherein the non-mesh material is selected from the group consisting of leather and synthetic leather.

14. The method of claim 11, wherein a lining of the outer tongue is formed from a mesh material.

15. The method of claim 14, wherein the lining of the outer tongue is laminated to a foam material.

16. The method of claim 9, wherein the outer tongue is positioned between a vamp and the inner tongue, and wherein the outer tongue is stitched into the vamp.

* * * * *